US005365890A

United States Patent [19]

Johnston, Jr. et al.

[11] Patent Number: 5,365,890

[45] Date of Patent: Nov. 22, 1994

[54] OPEN BEAM SOOTBLOWER

[75] Inventors: Jesse C. Johnston, Jr., Carroll; James S. Kulig; Steven F. Lewis, both of Lancaster; Eric C. Collet, Columbus, all of Ohio

[73] Assignee: The Babcock & Wilcox Company, New Orleans, La.

[21] Appl. No.: 128,840

[22] Filed: Sep. 29, 1993

Related U.S. Application Data

[62] Division of Ser. No. 34,251, Mar. 22, 1993, Pat. No. 5,299,533.

[51] Int. Cl.[5] ..... F23J 3/02

[52] U.S. Cl. ..... 122/379; 74/89.17; 74/396; 74/409

[58] Field of Search ..... 15/316.1, 317; 122/379, 122/390, 392, 382; 74/89.17, 396, 397, 409

[56] References Cited

U.S. PATENT DOCUMENTS

| | | | |
|---|---|---|---|
| 2,668,978 | 2/1954 | De Mart | 15/317 |
| 3,439,376 | 4/1969 | Nelson et al. | 15/317 |
| 3,580,095 | 5/1971 | Seed | 74/409 |
| 3,585,673 | 6/1971 | Nelson et al. | 15/317 |
| 3,604,050 | 9/1971 | Nelson et al. | 15/317 |
| 4,229,854 | 10/1980 | Johnston, Jr. | 15/316.1 |
| 4,351,082 | 9/1982 | Ackerman et al. | 15/316.1 |
| 5,189,923 | 3/1993 | Lashbrook | 74/409 |

*Primary Examiner*—William E. Tapolcai
*Attorney, Agent, or Firm*—Harness, Dickey & Pierce

[57] ABSTRACT

A retractable sootblower having a substantially open frame. The frame includes an inboard end wall, an outboard end wall and a pair of opposingly positioned side panels. The side panels are seamless and mounted to interconnect the inboard end and outboard end walls together. At least one truss extends between the side panels. The side panels cooperating with the inboard and outboard end walls to generally define a rectangularly shaped box for enclosing the carriage and lance tube of the sootblower. This box has a generally open top and bottom which provides substantially unobstructed access from above and below to the carriage and lance tube. The sootblower also includes a mechanism for adjusting the backlash between the drive rack and gear.

10 Claims, 3 Drawing Sheets

Fig-5
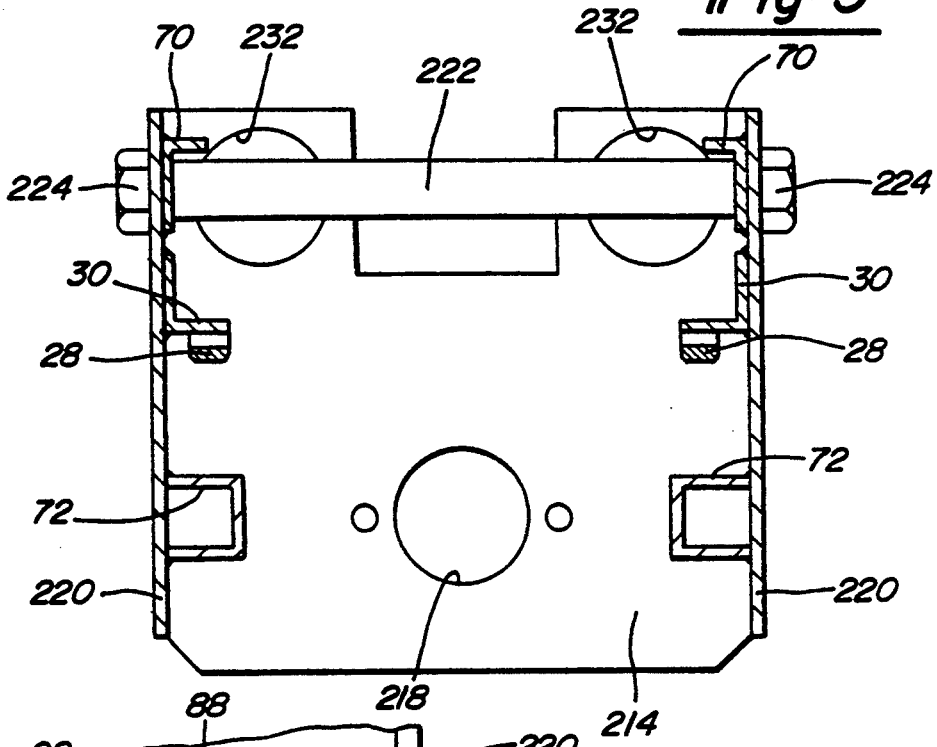
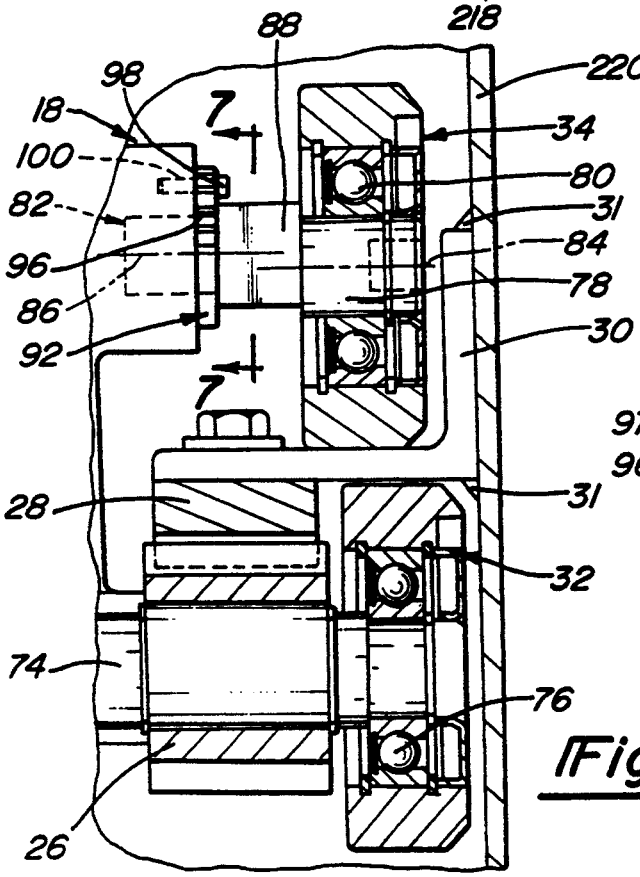
Fig-6
Fig-7
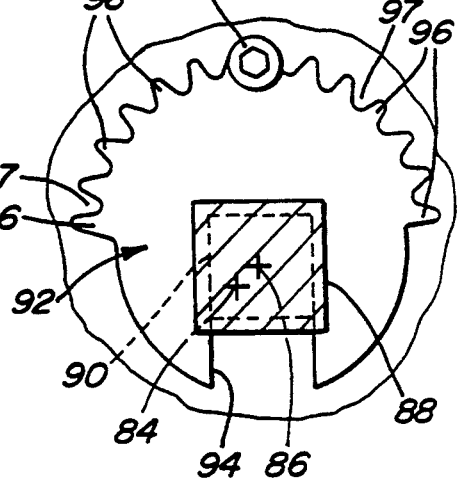

OPEN BEAM SOOTBLOWER

This is a continuation of U.S. patent application Ser. No. 08/034,251, filed Mar. 22, 1993 and entitled: Open Beam Sootblower, now U.S. Pat. No. 5,299,533.

BACKGROUND AND SUMMARY OF THE INVENTION

This invention generally relates to sootblowers and particularly relates to improvements in the frame structure and drive mechanism of a retractable sootblower.

Sootblowers are used to project a stream of blowing medium, such as water, air or steam, against heat transfer surfaces within large scale boilers or other heat exchangers to cause slag and ash encrustations to be removed. The impact of the blowing medium produces mechanical and thermal shock which causes the adhering encrustation layers to be removed.

One general category of sootblowers is known as the long retracting type. These devices have a retractable lance tube which is periodically advanced into and withdrawn from the boiler and which is simultaneously rotated such that one or more nozzles at the end of the lance tube project jets of blowing medium against the encrusted heat exchange surfaces in the boiler.

Sootblower designers are constantly striving to enhance design efficiency in terms of construction cost, operation, inventory cost and maintenance. In a conventional retractable sootblower, an elongated frame or beam houses a moveable carriage. The carriage drives a lance tube from one end of the frame to the other during the extension and retraction motion. Various configurations for sootblower frames are known.

In one well-known configuration, sheet metal plate stock is press brake formed to define three sides of a generally rectangular shaped member defining the elongated frame. In a typical installation, the open portion of the frame faces downward. The carriage is driven to move within the frame and the frame supports the lance tube suspended therein. Such conventional sootblower frames are known as closed frames since their upper surface is enclosed and inaccessible. Examples of presently known sootblower designs are provided with reference to U.S. Pat. Nos. 2,668,978; 3,439,376; 3,585,673; 3,604,050, 4,229,854 and 4,351,082. Although these closed frame type sootblowers perform in a satisfactory manner, they do have certain drawbacks.

One drawback results from the method in which the frame is formed. Since the three sided frame member is brake formed from flat sheet metal stock, a limitation on the length (typically twenty feet) of the member is presented by the brake forming machine. To form a longer frame member, separate three sided members are butt welded together. Obviously, forming the butt welds requires an additional and separate bonding step to be included in the production operation. Additionally, the presence of the weld is a site for corrosion development.

In certain sootblower applications, it is difficult to service the various mechanisms of the unit through the open bottom portion of the above mentioned closed frame. In these applications, a frame having an open upper portion which would allow the carriage, feed tube and lance tube and rack to be removed by withdrawing them up through the top portion of the sootblower frame would be more desirable. Although such open top sootblowers can be produced, when using conventional constructions, specifically designed units would have to be produced for specific installations.

In accordance with this invention a sootblower is provide having a frame which features an open construction enabling the sootblower components to be serviced or withdrawn through the bottom of the unit or through the top of the unit.

Another object of this invention is to provide a frame for a sootblower which can be constructed to any desired length while using a common inventory stock for all lengths. It is also an object to provide a sootblower frame in which the side panel are seamless and formed of a unitary construction.

Still another object of the invention is to provide a sootblower frame which is resistant corrosion and which is easily inspected for corrosion damage.

The various boiler configurations require retractable sootblowers of varying lengths. Such lengths range from only several feet long to ones well in excess of 60 feet. With conventional sootblower designs, the vast difference in size requirements has restricted the availability of common construction components thus increasing a manufacturer's inventory requirements and adversely affecting component costs.

The commonality of components becomes difficult since significantly different loads act on the frame structure as a function of the length of the sootblower lance tube. For example, as the extended length of the lance tube increases, the loads applied to the frame increase. In addition, significant loads, from both gravity and fluid reaction forces, act on the sootblower lance tube as it is performing its cleaning function. These loads are transferred to the sootblower carriage which is restrained by the frame.

Various designs for an open-type sootblower frame have been proposed. However, such devices are typically costly to manufacture and do not offer a high degree of accessibility since they are generally constructed to provide either top access or bottom access, but not both. Additionally, in an effort to achieve the necessary structural rigidity, closed box sections or tubes have been proposed which are welded to side panels to form ribs bridging the side panels. These closed tubes have also been used to define the side panels themselves. Although the closed tubes would provide adequate structural integrity, they too are available only in certain lengths and require butt welds or cutting to achieve the appropriate lengths. This again involves extra costs and waste. Moreover, closed box tubes are disadvantageous in that they cannot readily be inspected or protected from corrosion. Also, in order to keep their weight at an acceptable level, the metal thickness of the box tube sections must be kept relatively thin. This further degrades corrosion protection.

The sootblower frame in accordance with this invention is readily adapted for different lengths of sootblowers by using various lengths of flat sheet metal for the side panels of the frame. With the shorter sootblower lengths (up to approximately twenty-two feet) the sheet metal side panels can be used without further structural reinforcement. For intermediate lengths, angle iron is welded or bolted along the length of the side panels of the frame to increase its structural integrity and enable it to handle the loads associated with the longer length lance tube. The longest length devices, those generally greater than twenty-two feet in length, are further reinforced by adding an additional member to the side panels of the frame.

As mentioned previously, the requirements of joining separate lengths of stock material to form a sootblower frame of a desired length has its disadvantages. In accordance with this invention, a sootblower frame is provided in which the side panels can be formed from coiled sheet metal stock, available in substantially any length required. Since the side panels do not require forming of any type, with the exception of a flattening or straightening operation, length constraints are virtually eliminated and the side panels can be formed without seams thereby eliminating an inherent weakness of the prior designs.

In some sootblowers, a pair of laterally separated guide tracks or rails are provided to suspending the carriage as it moves between its advanced and retracted positions. Frequently, the lance tube is designed to be positioned off-center with respect to the two guide rails. This is known as handedness, left-handedness or right-handedness depending to which side of the lance tube is off-set.

Due to the significant fluid force of the blowing medium acting on the cross-section of the feed tube, substantial pressure forces also act on the carriage and the frame. When handedness is designed into the sootblower, significant imbalances in the forces applied are present. This leads to increased and uneven structural loading on both the frame and carriage. In one embodiment of the present invention, the sootblower features a balanced orientation with the lance tube being equidistantly positioned between the side tracks thus equalizing the loading of the frame.

In many sootblowers which are driven by a rotating pinion gear interacting with a toothed rack, difficulties are often presented in establishing the correct backlash or degree of intermeshing between the pinion gear and the rack. Improper backlash adjustment, with the backlash being too small, can lead to excessive loads on the various components and increased power consumption. Accelerated wear of the components occurs when the backlash is too great.

A sootblower in accordance with this invention incorporates a mechanism which readily permits the backlash of the pinion gear to be adjusted in the field. This mechanism utilizes an eccentric shaft to mount an upper carriage roller to the carriage. By changing the orientation of the eccentric shaft, and therefore the carriage roller with respect to the frame, the carriage can be raised or lowered with respect to the frame and the pinion gear adjusted relative to the rack.

Additional benefits and advantages of the present invention will become apparent to those skilled in the art to which this invention relates from the subsequent description of the preferred embodiments and the appended claims, taken conjunction with the accompanying drawings.

BRIEF DESCRIPTION OF THE DRAWINGS

FIG. 5 is a sectional view taken substantially along the line 5—5 in FIG. 4 showing additional reinforcement structures which may incorporated into the present;

FIG. 6 is a vertical sectional view through a portion of the present invention illustrating the mechanism for adjusting the backlash between the pinion gear and the rack of the sootblower; and FIG. 7 is a sectional view taken substantially along line 7—7 in FIG. 6 further showing the mechanism for adjusting the backlash between the pinion gear and the rack.

DETAILED DESCRIPTION OF THE PREFERRED EMBODIMENTS

Figure 1:
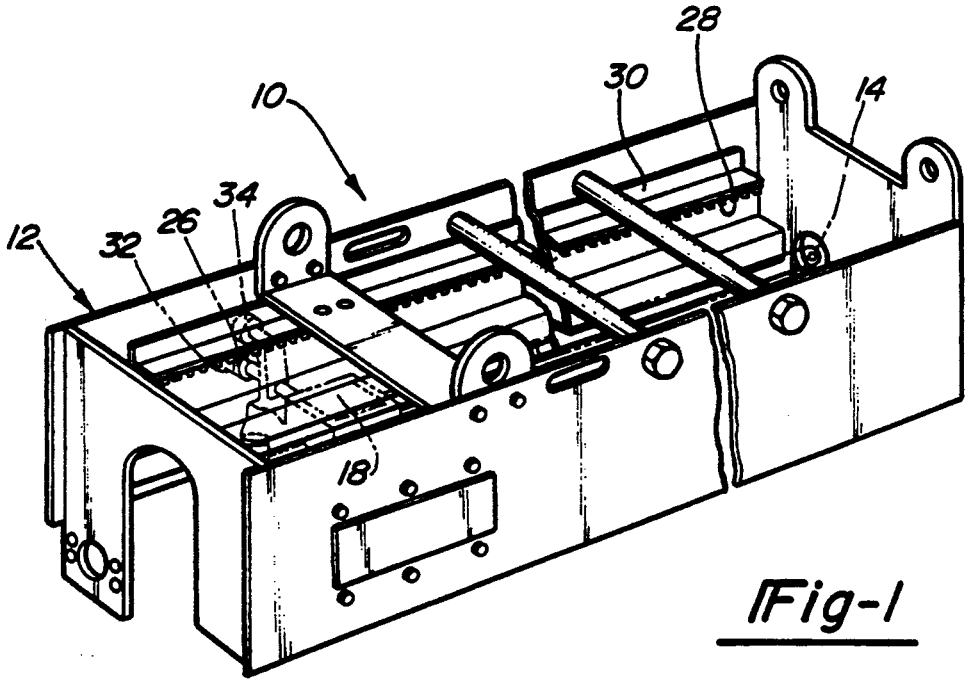
FIG. 1 is a pictorial view showing a long retracting sootblower incorporating the features of the present invention.

A sootblower including the improvements of the present invention is shown in FIG. 1 and generally designated therein by reference number 10. The sootblower 10 principally comprises a frame 12, a lance tube 14 and a carriage 18 (the carriage 18 and the lance tube 14 are shown in phantom). As seen in FIG. 1, the sootblower 10 is in its resting or retracted position. Upon actuation, the carriage 18 is advanced relative to the frame 12 causing the lance tube 14 to be extended into and subsequently retracted from a boiler (not shown).

Generally, the lance tube 14 is simultaneously rotated as it is advanced and retracted in the boiler. The carriage 18 drives the lance tube 14 into and out of the boiler and includes a drive motor, drive train and gear box (not shown) which are enclosed by the housing of the carriage. A drive system of the general type described above is disclosed in U.S. Pat. No. 5,065,472 which is commonly assigned to the Assignee of the present invention and hereby incorporated by reference. The drive motor drives a pair of pinion gears 26 which engage toothed racks 28 to advance the carriage 18 and the lance tube 14. The toothed racks 28 are respectively supported by a pair of tracks 30 connected to the frame 12 as further discussed below.

Often, a poppet valve is used to control the supplying of blowing medium to the sootblower 10. The poppet valve may be actuated through a linkage which is engaged by the carriage 18 during extension of the lance tube 14 to begin the discharge of the blowing medium. Similarly, the flow of blowing medium is cut off once the lance tube 14 and carriage 18 have returned to their fully retracted position.

A coiled electrical cable (not shown) conducts power to the drive motor as it moves with the carriage 18. A front support bracket (not shown), which includes rollers and bearings, is generally used to support the lance tube 14 during its longitudinal and rotational motion. For long lance tube lengths, an intermediate support, also having rollers and bearings, may be required to prevent excessive bending deflection of the lance tube 14. Additional details of the construction of a well known "IK" sootblower are found in U.S. Pat. No. 3,439,376, issued to the Assignee of the present invention and herein incorporated by reference.

Figure 2:
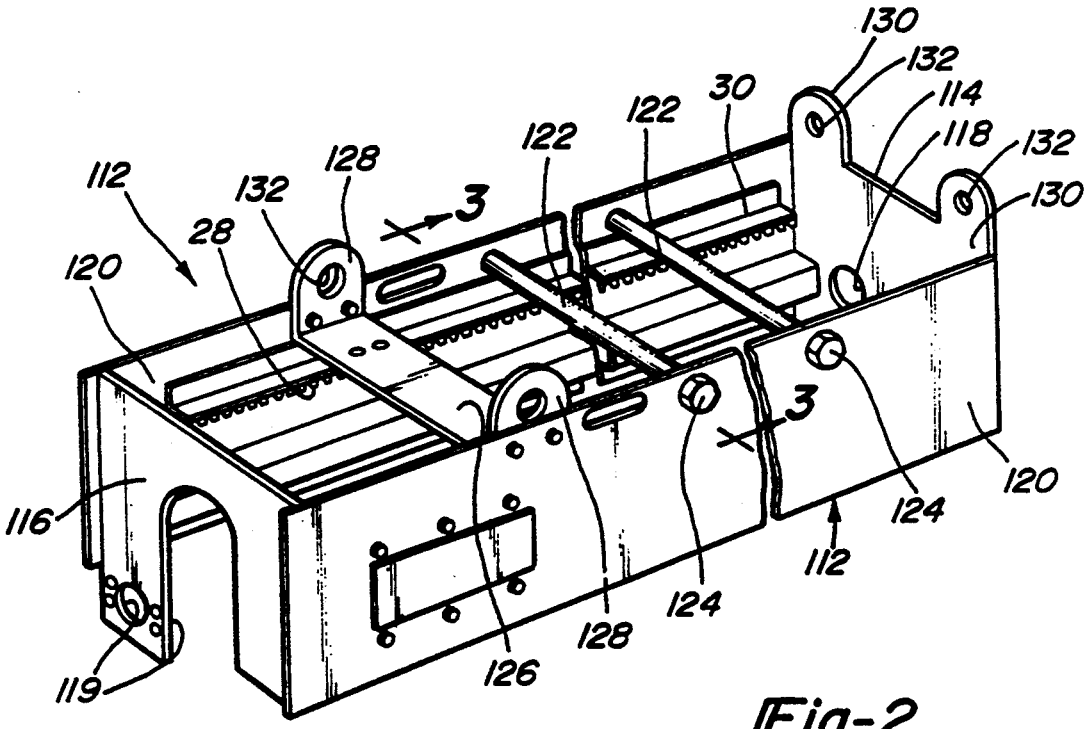
FIG. 2 is a perspective view of an open sootblower frame according to the principles of this invention and as generally seen in FIG. 1 with the carriage assembly and various related components being omitted.

Referring now to FIG. 2, a first embodiment of an open sootblower frame 112, embodying the principles of the present invention, is shown therein. The frame 112 of this embodiment is intended to be used in retro-fit applications where the carriage 18 and lance tube 14 display left or right handedness such that the lance tube 14 is offset from the centerline of the frame 112.

The frame 112 has a generally rectangular box-shaped configuration which is open at its top and bottom for easy access to the carriage 18 and the lance tube 14. The closed portions or sidewalls of the frame 112 include an inboard end wall 114, an outboard end wall 116 and side panels 120. The inboard end wall 114 is adapted for securement to the boiler wall or a wall box and includes a lance opening 118 which provides the lance tube 14 with access to a port in the boiler wall and the interior of the boiler itself. The outboard end wall 116 is positioned away from the boiler wall and can be provided with openings 119 that permit rear access to various features of the sootblower 10 when the carriage 18 is in its retracted position. The inboard and outboard end walls 114 and 116 are constructed from coiled sheet metal stock which has been flattened. Alternatively, these end walls can be manufactured from sheet metal plate stock which is easily cut the size or otherwise fabricated.

Extending between the inboard end wall 114 and the outboard end wall 116 are the sidewalls or side panels 120. The side panels 120 are formed from coiled sheet metal stock which has been flattened and cut to an appropriate size for the desired sootblower 10 length. Preferably, the side panels 120 have an approximate thickness of 5/16 of an inch which provides a significant amount of strength for most frame lengths, yet being easily reinforced for longer lengths. This thickness also provides a substantial amount of resistance to corrosion. By constructing each side panel 120 from one seamless or unitary piece of metal, the need for butt welding a number of individual panels together, along with the associated limitations, to form a long side panel is eliminated. Additionally, by eliminating the need for various side panel lengths, a manufacturer can significantly reduce the need for a large on-hand inventory stock and the costs associated with keeping a large amount of varying inventory.

In constructing the open frame 112 of the present invention, a desired length of coiled sheet metal stock is unrolled, flattened, straightened and cut to length for each side panel 120 of the frame 112. The end walls 114 and 116 are similarly fabricated. Each side panel 120 is then welded to opposing sides of the inboard and outboard end walls 114 and 116 to form a generally rectangularly shaped box having an open top and bottom.

Figure 3:
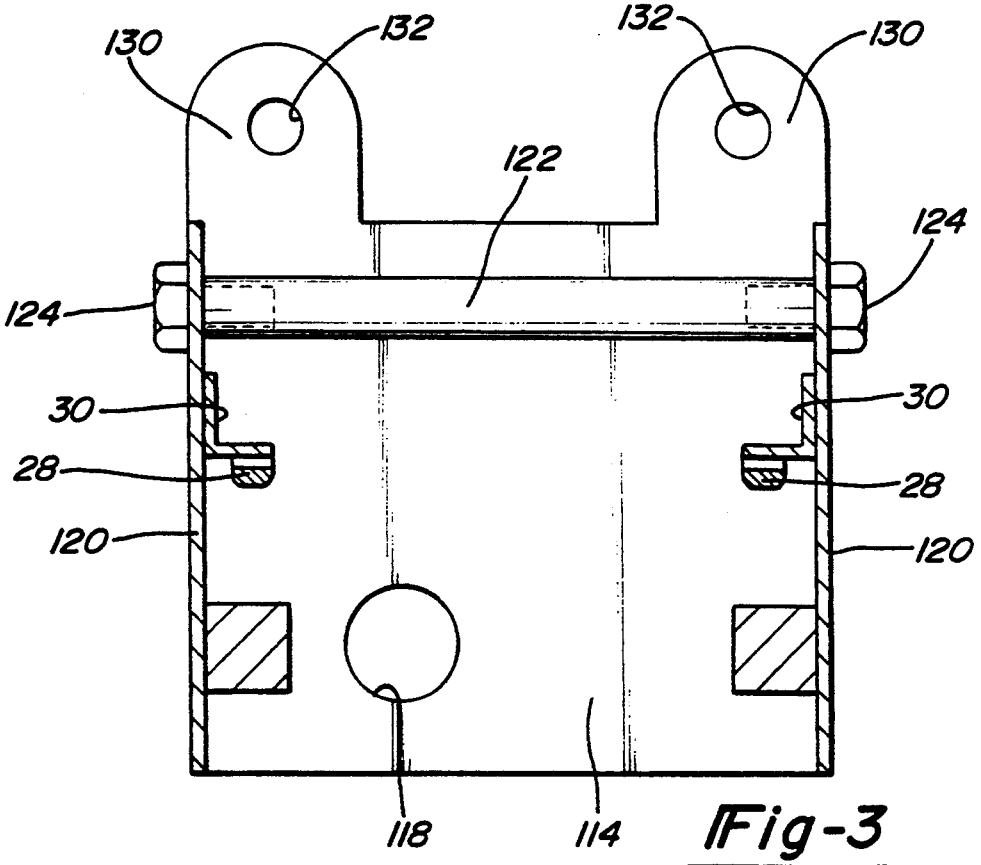
FIG. 3 is a sectional view taken substantially along line 3—3 in FIG. 2 showing one embodiment of the open sootblower frame of the present invention.

At various positions along its length, the frame 112 is provided with trusses 122 that extend between the side panels 120. In the illustrated embodiment, the trusses 122 are secured along an edge, preferably the upper edge, of the side panels so that they can be readily removed to provide substantially unobstructed access to the various components of the sootblower 10 for servicing while installed within the frame 112. As seen in FIGS. 2 and 3, the trusses 122 extend between the inside surfaces of the side panels 120 and are secured by threaded fasteners or bolts 124 extending through the side panels 120 directly into the trusses 122 themselves. The trusses 122 can be formed from a number of different materials, including metal rod stock, and can have a number of different configurations. In the illustrated embodiment, the trusses 122 are round bars having threaded bores in each end for receiving the bolts 124. If it is known that the particular sootblower being retrofitted is typically or more easily serviced from the top or the bottom, non-removable trusses 122 can be installed along the top or bottom, which ever is serviced less.

Figure 4:
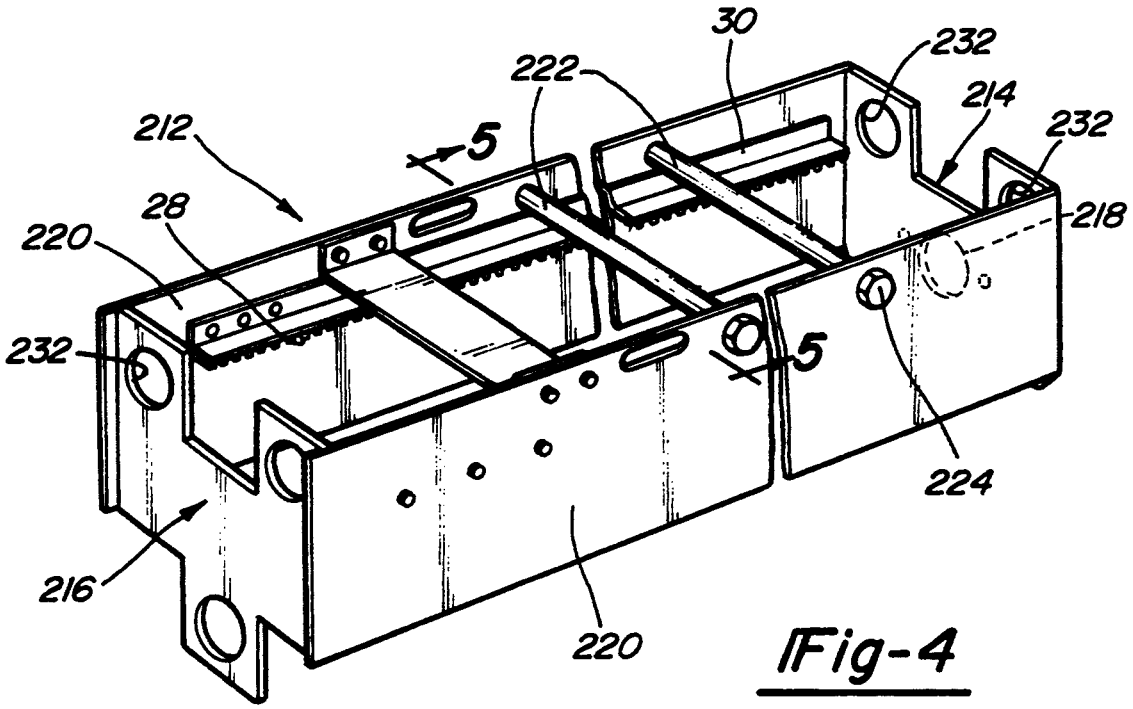
FIG. 4 is a perspective view of another embodiment of the open sootblower frame according to the principles of the present invention.

A second embodiment of the present invention is generally illustrated in FIG. 4. The frame 212 of this second embodiment is generally similar to the first embodiment in that it includes inboard and outboard end walls 214 and 216, as well as a pair of opposing, seamless side panels 220. One distinction, however, is that the frame 212 is intended to be used with a sootblower that does not exhibit left or right handedness. For this reason, the lance opening 218 of the inboard end wall 214 is substantially centered with respect to the side panels 220 and the inboard end wall 214. The non-handed or balanced sootblower results in more even reaction forces being applied to both of the frame side panels 220 during cleaning of the boiler.

Removable trusses 222, made from round bar stock and secured by bolts 224, extend between the side panels 220 again providing substantially unobstructed access to a carriage 18 within the frame 212 for easy servicing.

As generally shown in FIG. 5, additional features are added to the frames 112 and 212 to enhance their structural characteristics and enable frames 112 and 212 of increased lengths to be used. In the embodiment of FIGS. 4 and 5, instead of having ears 128 and 130 as shown in FIG. 3, hoist openings 232 are formed in the inboard and outboard end walls 214 and 216.

Applicants have found that for lengths less twenty-two feet, the thickness of the side panels provide enough strength themselves so that no additional structural enhancements are needed. For lengths in excess of twenty-two feet, an additional support member 70 is added along the upper edge of the side panels 220. As seen in FIG. 5, the support members 70 are sections of angle iron welded in place so as to extend along the upper interior edges of both side panels 220. Depending on the specific positioning of the support members 70, the trusses 222 may be located beneath, above, or at the support members 70. For frame lengths greater than thirty-four feet, in addition to the angle iron support members 70, a second support member 72, shown as a length of channel iron, is welded along an interior lower edge of each side panel 220. The additional structural enhancements enable the frame 212 to be constructed with side panels 220 of seamless construction and in lengths exceeding fifty feet.

While these enhancements are shown in connection with the second embodiment of the present invention, it is readily apparent that they are equally applicable to the construction of the first embodiment.

In both of the illustrated embodiments, the carriage 18 is supported for translational movement within the frames 112 and 212. The following discussion deals with the supporting and adjusting of the carriage 18 within the frames 112 and 212. While only discussed in connection with the second embodiment, the following is equally applicable to both embodiments.

The toothed racks 28 are downwardly facing and rigidly mounted along an inboard edge of the lower surface of the tracks 30 which are themselves constructed from angle iron welded at 31 to the interior surfaces of the side panels 220. Lower support bearings or carriage rollers 32, mounted outboard of the pinion gears 26, engage the lower surface of the tracks 30 and help support the carriage 18 on the frame 12 when the lance tube 14 is extended. Upper carriage rollers 34 are mounted to the carriage 18 so as to engage the upper surface of the tracks 30 and generally support the suspended carriage 18 and lance tube 14.

As further discussed below, the upper carriage rollers 34 include a mechanism which allows the backlash between the pinion gears 26 and the rack 28 to be readily adjusted. If the backlash is too small, excessive loads may be applied to the teeth of the pinion gear 26 and rack 28. If too great, the backlash can result in accelerated wear of the various components.

The pinion gears 26 engage the toothed racks 28 to advance and retract the lance tube 14. The lower carriage rollers 32 are supported on the same drive shaft 74, as the pinion gears 26, but are provided with bearing assemblies 76 which allow the carriage rollers 32 to free wheel relative to the drive shaft 74. The lower carriage roller 32 generally engage the lower tracks 29 when the carriage 18 is retracted, but also engage the lower surface of the upper tracks 30 because of the unsupported weight of the lance tube 14 when the carriage 18 is advanced and the lance tube 14 extended into the boiler.

The upper carriage roller 34 is supported by a non-driven shaft 78 and includes bearings 80 which allow the carriage roller 34 to free wheel relative to the shaft 78. The shaft 78 includes an eccentric portion 82 and, as such, two axes 84 and 86 are defined. One axis of rotation 84 is for the carriage roller 34 and the other is the axis 86 along which the eccentric portion 82 extends into the carriage 18 where it is mounted for relative rotation. The shaft 78 is provided with the eccentric portion 82 so that the backlash between the pinion gears 26 and the toothed racks can be adjusted in response to rotation of the eccentric portion 82.

This means for adjusting the backlash operates to raise or lower the carriage 18 and the pinion gears 26 relative to the toothed racks 28. By rotating the eccentric portion 82 about its axis 86, the rotational axis of the shaft 78 will be raised or lowered, along with the carriage 18 and pinion gears 26, depending on the direction of rotation. To permit easy adjustment and to maintain the carriage rollers 34 at the relative height for proper backlash, the eccentric portion 82 is provided with a cross-sectionally square portion 88, having dimensions for being engaged by a wrench, between the carriage rollers 34 and the carriage 18. The square portion 88 includes a recess 90 immediately adjacent to the carriage 18 which receives an adjustment plate 92 having a slot 94. The adjustment plate 92 is generally circular in shape and is provided with a number of teeth 96 along at least a portion of its perimeter. The gaps 97 between adjacent teeth 96 are provided to correspond with a cap screw 98 which extends into a threaded bore 100 in the carriage 18.

When the cap screw 98 is removed, a wrench can be applied to the square portion 88 to rotate the eccentric portion 82, along with the adjustment plate 92, until the axis of rotation 84 has been raised or lowered creating the correct amount of backlash. The bore 100 is then aligned with the nearest gap 97 and the cap screw 98 threaded into the bore 100 to secure the mechanism in position with the proper amount of backlash.

By mounting the adjustment plate 92 within the recess 90 of the eccentric portion 82, the plate 92 also serves to axially retain the eccentric portion 82, shaft 78 and upper carriage roller 34 to the carriage 18.

To assist in positioning the frames 112 and 212 relative to the boiler and other support structures, the frames 112 and 212 may be provided with various structures which will enable lifting of the frames 112 and 212 by a hook and cable suspended from a crane. In the first embodiment, a lifting brace 126 is removably secured between the side panels 120 and is provided with upwardly extending ears 128. The inboard end wall 114 is also provided with upwardly extending ears 130. The ears 128 and 130 are each provided with openings 132 that enable hooks or other engagement structure to attach onto the frame 112 and hoist the frame 112 for securement in its final position or enable it to be removed for replacement or servicing. In the embodiment of FIGS. 4 and 5, instead of having ears 128 and 130, hoist openings 232 are formed in the inboard and outboard end walls 214 and 216.

While the above description constitutes the preferred embodiments of the present invention, it will be appreciated that the invention is susceptible to modification, variation and change without departing from the proper scope and fair meaning of the accompanying claims.

I claim:

1. A mechanism for adjusting backlash in a retractable sootblower of the type including a lance tube and a carriage assembly moveable within a frame, the carriage assembly having a drive means for advancing and retracting the lance tube into and out of a combustion device the drive means including a drive gear engaging a stationary toothed rack mounted to the frame with a predetermined amount of backlash, said mechanism comprising:

a longitudinal track mounted to the frame;

a carriage roller engaging said track for movement therealong during advancement and retraction of the lance tube;

means for mounting said carriage roller to the carriage assembly, said mounting means also including adjusting means for vertically adjusting the position of said carriage roller relative to the carriage assembly thereby varying the engagement between the drive gear and the rack to adjust the amount of backlash exhibited therebetween.

2. A mechanism for adjusting backlash in a retractable sootblower as set forth in claim 1 wherein said adjusting means includes an eccentric shaft having a first end portion defining a first axis and a second end portion defining a second axis offset from said first axis, said first end portion being mounted to said carriage for relative rotation therewith, said second end portion having said carriage roller mounted thereon for relative rotation therewith.

3. A mechanism for adjusting backlash in a retractable sootblower as set forth in claim 2 wherein said eccentric shaft includes means for securing said eccentric shaft in one of a number of predetermined radial positions to thereby prohibit relative rotation between said eccentric shaft and said carriage assembly.

4. A mechanism for adjusting backlash in a retractable sootblower as set forth in claim 3 wherein said means for securing said eccentric shaft includes a fastener engaged with said carriage assembly and interferingly preventing rotation of said shaft.

5. A mechanism for adjusting backlash in a retractable sootblower as set forth in claim 4 wherein said means for securing said eccentric shaft further includes a plate mounted to said eccentric shaft so as to be interferingly engagable with said fastener.

6. A mechanism for adjusting backlash in a retractable sootblower as set forth in claim 5 wherein said plate includes a plurality of toothed projections along a perimeter thereof, adjacent toothed projections having gaps therebetween correspondingly positioned to receive said fastener therein and prevent rotation of said shaft.

7. A mechanism for adjusting backlash in a retractable sootblower as set forth in claim 6 wherein said eccentric shaft includes a recessed groove, said plate being received in said recessed groove.

8. A mechanism for adjusting backlash in a retractable sootblower as set forth in claim 2 wherein said eccentric shaft includes means for rotating said eccentric shaft relative to said carriage assembly.

9. A mechanism for adjusting backlash in a retractable sootblower as set forth in claim 8 wherein said means for rotating said eccentric shaft includes a wrench engaging portion.

10. A mechanism for adjusting backlash in a retractable sootblower as set forth in claim 9 wherein said wrench engaging portion is between said carriage roller and the carriage assembly.

* * * * *